US010597869B2

(12) United States Patent
Evans et al.

(10) Patent No.: US 10,597,869 B2
(45) Date of Patent: Mar. 24, 2020

(54) UNBONDED LOOSEFILL INSULATION

(75) Inventors: Michael E. Evans, Granville, OH (US); Patrick M. Gavin, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 955 days.

(21) Appl. No.: 12/924,974

(22) Filed: Oct. 8, 2010

(65) Prior Publication Data

US 2011/0086226 A1 Apr. 14, 2011

Related U.S. Application Data

(60) Provisional application No. 61/250,244, filed on Oct. 9, 2009.

(51) Int. Cl.

| | |
|---|---|
| ***E04B 1/78*** | (2006.01) |
| ***D02G 3/00*** | (2006.01) |
| ***E04B 1/76*** | (2006.01) |

(52) U.S. Cl.

CPC ..... *E04B 1/7604* (2013.01); *Y10T 428/298* (2015.01)

(58) Field of Classification Search

None

See application file for complete search history.

(56) References Cited

U.S. PATENT DOCUMENTS

| | | | | |
|---|---|---|---|---|
| 3,584,796 | A * | 6/1971 | Earle et al. | 241/4 |
| 4,777,086 | A | 10/1988 | Madden et al. | |
| 5,624,742 | A * | 4/1997 | Babbitt et al. | 428/212 |
| 5,683,810 | A | 11/1997 | Babbitt et al. | |
| 5,786,082 | A * | 7/1998 | Evans et al. | 428/369 |
| 6,329,052 | B1 * | 12/2001 | Groh et al. | 428/360 |
| 6,562,257 | B1 | 5/2003 | Chen et al. | |
| 2006/0231651 | A1 | 10/2006 | Evans et al. | |
| 2008/0087751 | A1 | 4/2008 | Johnson et al. | |
| 2008/0089748 | A1 | 4/2008 | Johnson et al. | |

* cited by examiner

*Primary Examiner* — Shawn Mckinnon

(74) *Attorney, Agent, or Firm* — MacMillan, Sobanski & Todd, LLC

(57) ABSTRACT

An improved unbonded loosefill insulation material having a multiplicity of tufts and a plurality of voids between the tufts is provided. The tufts have an average major tuft dimension. The average major tuft dimension of the tufts of the improved unbonded loosefill insulation material is shorter than an average major tuft dimension of tufts of conventional unbonded loosefill insulation material, thereby providing the improved unbonded loosefill insulation material with a higher insulative value than conventional unbonded loosefill insulation material.

18 Claims, 13 Drawing Sheets
(10 of 13 Drawing Sheet(s) Filed in Color)

Fig. 2 – Prior Art

Fig. 3 – Prior Art

80

| | Air Flow Resistance @ 0.50 pcf (cgs Rayls/in) | Fiber Diameter (HT) | Thermal Conductivity (K) @ 0.50 pcf (Btu-in/hr-ft$^2$-°F) |
|---|---|---|---|
| 82a Improved – Facility 1 | 2.06 | 13 | 0.321 |
| 82b Improved – Facility 2 | 1.70 | 13 | 0.329 |
| 82c Conventional – Facility 1 | 1.32 | 11 | 0.345 |
| 82d Conventional – Facility 2 | 1.37 | 10 | 0.342 |

*Fig. 11*

UNBONDED LOOSEFILL INSULATION

RELATED APPLICATIONS

This application claims the benefit of pending U.S. Provisional Patent Application No. 61/250,244, filed Oct. 9, 2009, the disclosure of which is incorporated herein by reference.

BACKGROUND

In the insulation of buildings, a frequently used insulation product is loosefill insulation material. In contrast to the unitary or monolithic structure of insulation batts or blankets, loosefill insulation material is a multiplicity of discrete, individual tufts, cubes, flakes or nodules. Loosefill insulation material can be applied to buildings by blowing the loosefill insulation material into insulation cavities, such as sidewall cavities or an attic of a building.

Loosefill insulation material can be made from glass fibers, although other mineral fibers, organic fibers, and cellulose fibers can be used.

Loosefill insulation material, also referred to as blowing wool, can be compressed in packages for transport from an insulation manufacturing site to a building that is to be insulated. The compressed loosefill insulation material can be encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of the loosefill insulation material into an insulation cavity typically uses a blowing wool distribution machine that conditions the loosefill insulation material and feeds the conditioned loosefill insulation material pneumatically through a distribution hose. Blowing wool distribution machines typically have a chute or hopper for containing and feeding the loosefill insulation material after the package is opened and the compressed loosefill insulation material is allowed to expand.

It would be advantageous if the loosefill insulation material used in the blowing wool machines could have improved insulative value.

SUMMARY OF THE INVENTION

The above objects as well as other objects not specifically enumerated are achieved by an improved unbonded loosefill insulation material having a multiplicity of tufts and a plurality of voids between the tufts. The tufts have an average major tuft dimension. The average major tuft dimension of the tufts of the improved unbonded loosefill insulation material is shorter than an average major tuft dimension of tufts of conventional unbonded loosefill insulation material, thereby providing the improved unbonded loosefill insulation material with a higher insulative value than conventional unbonded loosefill insulation material.

According to this invention there is also provided an improved unbonded loosefill insulation material having a multiplicity of tufts and a plurality of voids between the tufts. The tufts have a tuft density. The tuft density of the tufts of the improved unbonded loosefill insulation material is less than the tuft density of the tufts in conventional unbonded loosefill insulation material, thereby providing the improved unbonded loosefill insulation material with a higher insulative value than conventional unbonded loosefill insulation material.

According to this invention there is also provided an improved unbonded loosefill insulation material having a multiplicity of tufts and a plurality of voids between the tufts. The tufts have an outer surface including a plurality of irregularly-shaped projections. The tufts of the improved unbonded loosefill insulation material have more irregularly-shaped projections than the tufts in conventional unbonded loosefill insulation material, thereby providing the improved unbonded loosefill insulation material with a higher insulative value than conventional unbonded loosefill insulation material.

According to this invention there is also provided an improved unbonded loosefill insulation material having a multiplicity of tufts and a plurality of voids between the tufts. The tufts have an outer surface formed from a plurality of irregularly-shaped projections. The irregularly-shaped projections have a plurality of hairs extending therefrom. The tufts of the improved unbonded loosefill insulation material have more hairs extending from irregularly-shaped projections than the tufts in conventional unbonded loosefill insulation material, thereby providing the improved unbonded loosefill insulation material with a higher insulative value than conventional unbonded loosefill insulation material.

According to this invention there is also provided an improved unbonded loosefill insulation material having a multiplicity of tufts and a plurality of voids between the tufts. The tufts have tuft gaps within the tufts. The tuft gaps have a size. The size of the tuft gaps within the tufts of the improved unbonded loosefill insulation material are larger than the size of the tuft gaps within the tufts of conventional unbonded loosefill insulation material, thereby providing the improved unbonded loosefill insulation material with a higher insulative value than conventional unbonded loosefill insulation material.

According to this invention there is also provided an improved unbonded loosefill insulation material having a multiplicity of tufts and a plurality of voids between the tufts. The tufts have tuft gaps within the tufts. The tuft gaps have a gap frequency of occurrence. The gap frequency of occurrence of the tuft gaps within the tufts of the improved unbonded loosefill insulation material is greater than the gap frequency of occurrence of the tuft gaps within the tufts in conventional unbonded loosefill insulation material, thereby providing the improved unbonded loosefill insulation material with a higher insulative value than conventional unbonded loosefill insulation material.

According to this invention there is also provided an improved unbonded loosefill insulation material having a multiplicity of tufts and a plurality of voids between the tufts. The tufts have tuft gaps within the tufts. The tuft gaps have a gap distribution. The distribution of the tuft gaps within the tufts of the improved unbonded loosefill insulation material is more even than the distribution of the tuft gaps within the tufts in conventional unbonded loosefill insulation material, thereby providing the improved unbonded loosefill insulation material with a higher insulative value than conventional unbonded loosefill insulation material.

According to this invention there is also provided an improved unbonded loosefill insulation material having a multiplicity of tufts and a plurality of voids between the tufts. The tufts have tuft gaps within the tufts. The tuft gaps have a gap distribution. The distribution of the tuft gaps within the tufts of the improved unbonded loosefill insulation material is more even than the distribution of the tuft gaps within the tufts in conventional unbonded loosefill insulation material, thereby providing the improved unbonded loosefill insulation material with a higher insulative value than conventional unbonded loosefill insulation material.

According to this invention there is also provided an improved unbonded loosefill insulation material having a multiplicity of tufts and a plurality of voids between the tufts. The tufts have fibers. The fibers have a diameter. The improved unbonded loosefill insulation material has a higher insulative value than conventional unbonded loosefill insulation material at the same fiber diameter.

Various objects and advantages of this invention will become apparent to those skilled in the art from the following detailed description of the various embodiments, when read in light of the accompanying drawings.

BRIEF DESCRIPTION OF THE DRAWINGS

The patent or application file may contain one or more drawings executed in color and/or one or more photographs. Copies of this patent or patent application publication with color drawing(s) and/or photograph(s) will be provided by the Office upon request and payment of the necessary fee.

FIG. 11 is a chart illustrating Fiber Diameter vs. Thermal Conductivity of the improved unbonded loosefill insulation material of FIG. 4 and the conventional unbonded loosefill insulation material of FIG. 2.

DETAILED DESCRIPTION OF THE INVENTION

Figure 1:
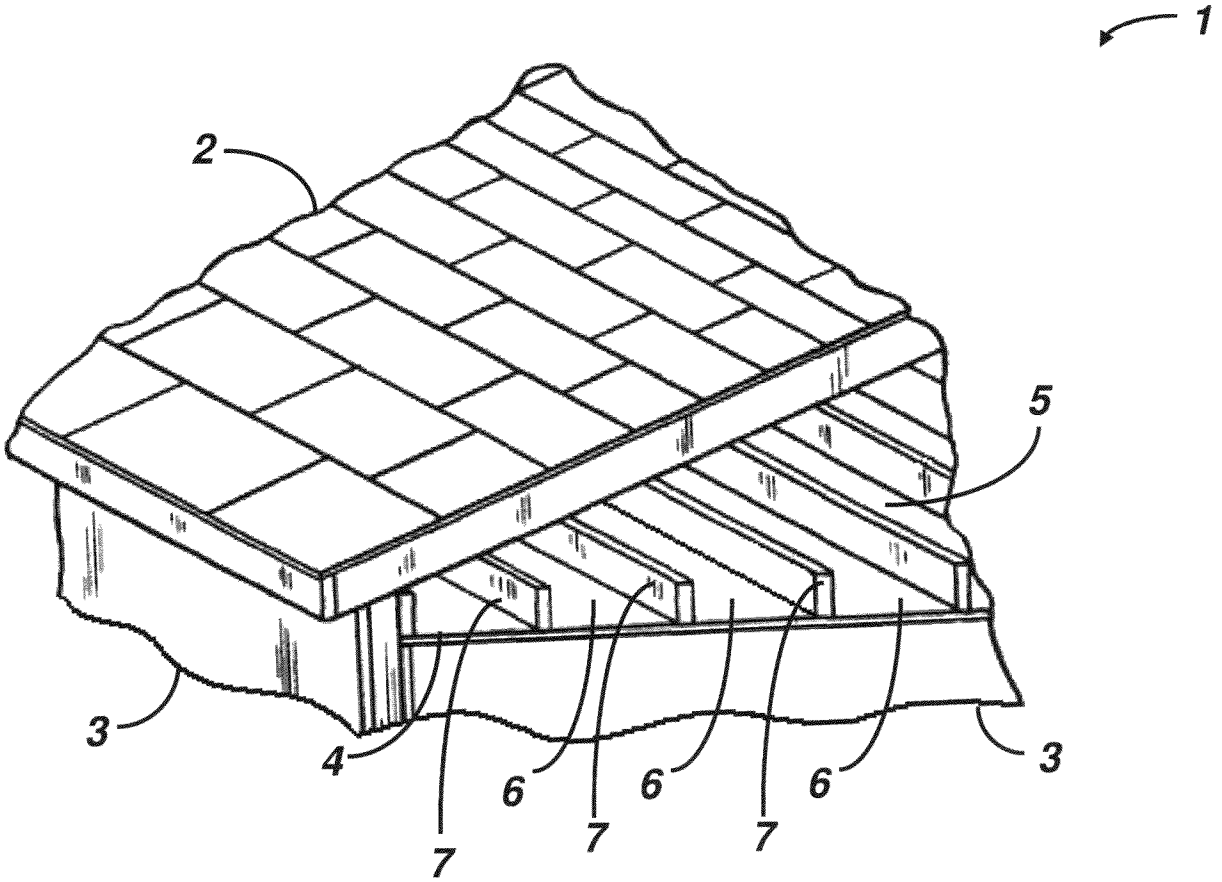
FIG. 1 is a perspective view of a building with an attic having insulation cavities.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose improved unbonded loosefill insulation material (hereafter "loosefill material") for use in a blowing wool machine. Generally, the loosefill material has physical characteristics that provide for improved insulative properties. The loosefill material includes individual "tufts" that also have physical characteristics that also provide for improved insulative properties. The term "loosefill insulation material", as used herein, is defined to any conditioned insulation material configured for distribution in an airstream. The term "unbonded", as used herein, is defined to mean the absence of a binder.

As discussed above, compressed loosefill material can expand into a blowing wool machine configured to "condition" the loosefill material for distribution into insulation cavities. The term "condition" as used herein, is defined to mean the shredding of the loosefill material to a desired density prior to distribution into an airstream. Blowing wool machines can include various mechanisms or combinations of mechanisms, such as for example shredders, beater bars and agitators for final shredding of the loosefill material prior to distribution. Once conditioned, the loosefill material can be distributed pneumatically through a distribution hose.

Referring now to FIG. 1, a building is illustrated generally at 1. The building 1 includes a roof deck 2, exterior walls 3 and an internal ceiling 4. An attic space 5 is formed internal to the building 1 by the roof deck 2, exterior walls 3 and the internal ceiling 4. A plurality of structural members 7 positioned in the attic space 5 and above the internal ceiling 4 defines a plurality of insulation cavities 6. As discussed above, the insulation cavities 6 can be filled with loosefill material.

Figure 2:
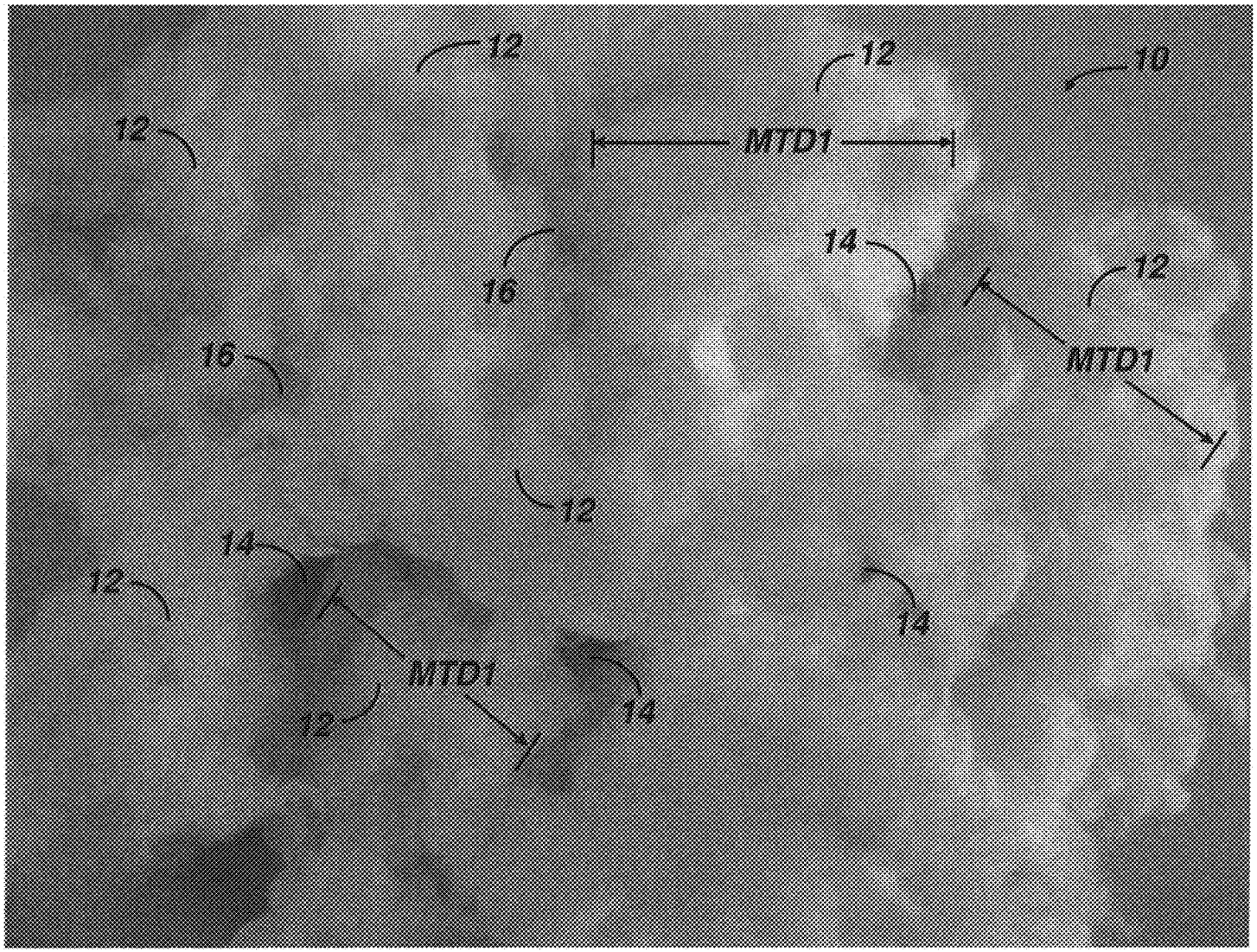
FIG. 2 is an enlarged color photograph illustrating conventional unbonded loosefill insulation material.

Referring now to FIG. 2, a sample of conventional loosefill material is illustrated generally at 10. For purposes of clarity, the sample of conventional loosefill material 10 has been magnified by an approximate factor of 2×. The loosefill material 10 has been conditioned by a blowing wool machine (not shown). Any desired blowing wool machine can be used. The loosefill material 10 includes a multiplicity of individual "tufts" 12. The term "tuft", as used herein, is defined to mean any cluster of insulative fibers.

Referring again to FIG. 2, a first physical characteristic of the sample of conventional loosefill material 10 is "voids". The term "void" as used herein, is defined to mean a space between adjoining tufts 12. The voids can be complete voids, meaning the absence of any loosefill insulation fibers in the space between the adjacent tufts, 12 or partial voids, meaning a minimal amount of loosefill insulation fibers in the space between the adjacent tufts 12. Complete voids 14 and partial voids 16 are illustrated in FIG. 2. The voids, 14 and 16, have a size, a frequency of occurrence and a distribution. The term "void size", as used herein, is defined to mean the average length of the space between adjoining tufts 12. The term "void frequency of occurrence", as used herein, is defined to mean the number of void occurrences per volumetric measure. The term "void distribution", as used herein, is defined to mean the grouping or degree of concentration of the voids per volumetric measure. The void size, void frequency of occurrence and void distribution of the voids, 14 and 16, are some of the factors that determine the insulative value ("R value") of the loosefill material 10. The term "R value", as used herein, is defined to mean a measure of thermal resistance and is usually expressed as $ft^{2}\cdot{}^{\circ}$ F.·h/Btu.

As shown in FIG. 2, the conventional void size is in a range of from about 2.8 mm to about 9.9 mm. The conventional void frequency of occurrence is in a range of from about 1.1 per cubic centimeter to about 2.6 per cubic centimeter. The conventional void distribution is in a range of from about 1.1 per cubic centimeter to about 2.6 per cubic centimeter. The void size, void frequency of occurrence and void distribution of the voids, 14 and 16, will be discussed in more detail below.

The void size, void frequency of occurrence and void distribution of the voids, 14 and 16, can be measured by various image analysis techniques. The term "image analysis", as used herein, is defined to mean the extraction of meaningful information from images, including digital images. In some instances, the image analysis techniques can include x-ray computed tomography, optical microscopy and magnetic resonance imaging. In other instance, higher resolution imaging can be employed with electron microscopy.

As further shown in FIG. 2, a second physical characteristic of the tufts 12 is an average "major tuft dimension" MTD1. The term "major tuft dimension", as used herein, is defined to mean the average length of a tuft 12 along its longest segment. The major tuft dimension MTD1 can be another determinative factor of the insulative value of the loosefill material 10. As shown in FIG. 2, the conventional average major tuft dimension MTD1 is in a range of from about 2.8 mm to about 9.9 mm. The major tuft dimension MTD1 can be measured using the various image analysis techniques discussed above.

Referring again to FIG. 2, a third physical characteristic of the tufts 12 is a "tuft density". The term "tuft density", as used herein, is defined to mean the weight of the loosefill material 10 per volumetric measure of tuft 12. As shown in FIG. 2, the tuft density of the tufts 12 can be relatively dense as visually observed from the apparent compaction of the loosefill material 10 within the tufts 12. The tuft density can be another determinative factor of the insulative value of the loosefill material 10. The major tuft dimension of the conventional loosefill material is in a range of from about 4.4 kilograms per cubic meter to about 14.6 kilograms per cubic meter. The tuft density can be measured using the various image analysis techniques discussed above.

Figure 3:
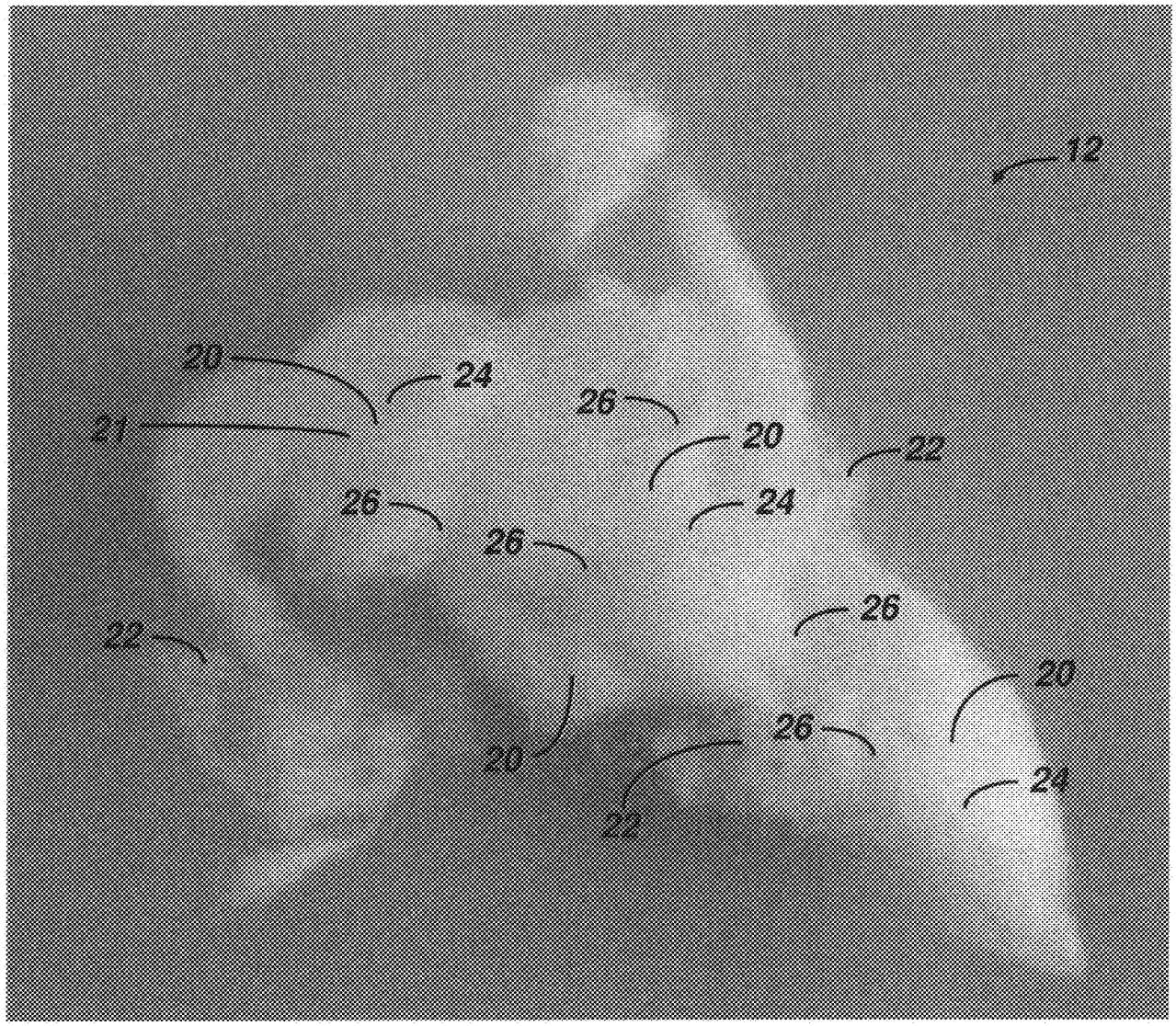
FIG. 3 is an enlarged color photograph illustrating an individual tuft of the conventional unbonded loosefill insulation material of FIG. 2.

Referring now to FIG. 3, an individual tuft 12 of the conventional loosefill material 10 is illustrated. For purposes of clarity, the individual tuft 12 has been magnified by an approximate factor of 8×. A fourth physical characteristic of the tuft 12 is a plurality of irregularly-shaped projections 20 extending from an outer surface 21 of the tuft 12. The term "projection', as used herein, is defined to mean any bump, protrusion or extension of the outer surface 21 of the tuft 12. The percentage of the outer surface 21 of the tuft 12 having irregularly-shaped projections 20 can be another determinative factor of the insulative value of the loosefill material 10. As shown in FIG. 3, the outer surface 21 of the tuft 12 is has irregularly-shaped projections 20 in an amount in the range of from about 40% to 60%. The percentage of the irregularly-shaped projections can be measured using the various image analysis techniques discussed above.

Referring again to FIG. 3, a fifth physical characteristic of the tuft 12 is a plurality of "hairs" 22 extending from the irregularly-shaped projections 20 of the tuft 12. The term "hairs", as used herein, is defined to mean any portion of the insulation fibers extending from the irregularly-shaped projections 20. While the hairs 22 are shown in FIG. 3 as extending from the irregularly-shaped projections 20, it should be appreciated that the hairs 22 can also extend from the irregularly-shaped projections 20 into the body of the tuft 12. The quantity of irregularly-shaped projections 20 having hairs extending therefrom can be another determinative factor of the insulative value of the loosefill material 10. As shown in FIG. 3, approximately 50% to 60% of the irregularly-shaped projections 20 have extending hairs 22. The percentage of the irregularly-shaped projections 20 having extending hairs 22 can be measured using the various image analysis techniques discussed above.

Referring again to FIG. 3, the tuft 12 includes a multiplicity of fibers 24 arranged in a random orientation. The term "fibers", as used herein, is defined to mean any portion of the loosefill material 10. A sixth physical characteristic of the tufts 12 is "gaps" 26. The term "gaps" as used herein, is defined to mean a portion of the tuft 12 having a lighter density than other portions of the tuft 12. The gaps 26 have a gap size, a gap frequency of occurrence and a gap distribution. The gap size, gap frequency of occurrence and gap distribution are additional factors that can determine the insulative value ("R value") of the loosefill material 10.

The term "gap size", as used herein, is defined to mean the average length of the portion of the tuft 12 having a lighter density. The term "gap frequency of occurrence", as used herein, is defined to mean the number of gap 26 occurrences per volumetric measure. The term "gap distribution", as used herein, is defined to mean the grouping or concentration of the gaps 26 per volumetric measure. As shown in FIG. 3, the gap size of the conventional tuft 12 is in a range of from about 1.0 mm to about 2.1 mm. The gap frequency of occurrence of the conventional tuft 12 is in a range of from about 1.1 per cubic centimeter to about 2.6 per cubic centimeter. The gap distribution of the conventional tuft 12 is in a range of from about 1.1 per cubic centimeter to about 2.6 per cubic centimeter. The gap size, gap frequency of occurrence and gap distribution of the tufts 12 will be discussed in more detail below. The gap size, gap frequency of occurrence and gap distribution of the tufts 12 can be measured using the various image analysis techniques discussed above.

Referring again to FIG. 3, a seventh physical characteristic of the tuft 12 is a generally elongated shape. The term "elongated", as used herein, is defined to mean a longer and thinner shape. The generally elongated shape of the tuft 12 results in less cubic consistency. The term "cubic consistency", as used herein, is defined to mean the percentage of an object that fills a cubically-shaped volume. In the illustrated embodiment, the tuft 12 fills a cubically-shaped volume in a range of from about 30% to about 60%. The cubically-shaped volume of the tufts 12 can be measured using the various image analysis techniques discussed above.

Figure 4:
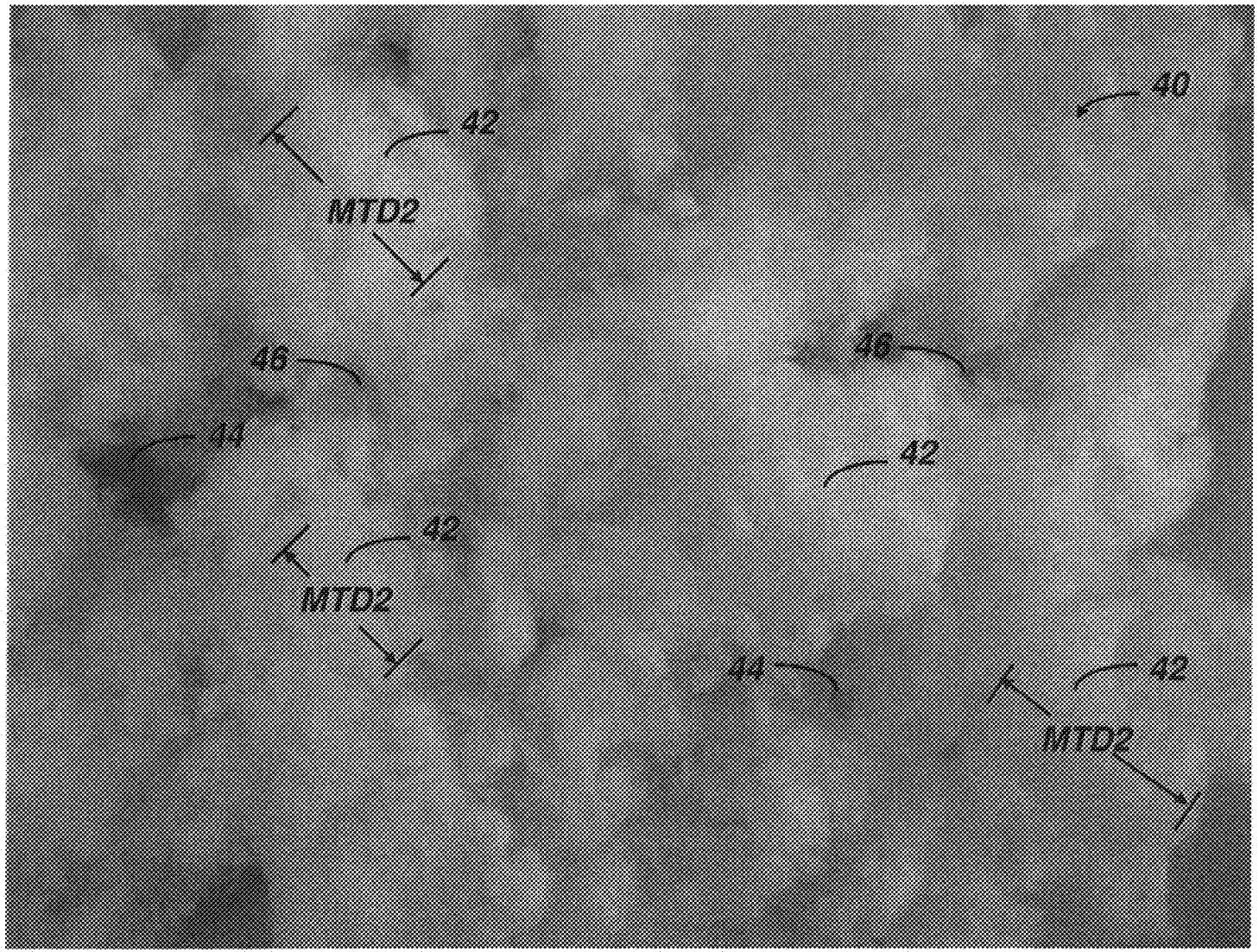
FIG. 4 is an enlarged color photograph illustrating improved unbonded loosefill insulation material according to the invention.

Referring now to FIG. 4, a sample of improved loosefill material is illustrated generally at 40. For purposes of clarity, the sample of improved loosefill material 40 has been magnified by an approximate factor of 2×. The loosefill material 40 has been conditioned by a blowing wool machine (not shown). The loosefill material 40 includes a multiplicity of individual "tufts" 42.

The improved loosefill material 40 and the tufts 42 can be described using the same physical characteristics discussed above. First, the improved loosefill material 40 has complete voids 44 and partial voids 46. The complete and partial voids, 44 and 46, have a void size, a void frequency of occurrence and a void distribution. As discussed above, the void size, void frequency of occurrence and void distribution are factors in determining the insulative value ("R value") of the loosefill material 40.

As shown in FIG. 4, the void size of the improved loosefill material 40 is in a range of from about 2.5 mm to about 7.6 mm. The void frequency of occurrence of the improved loosefill material 40 is in a range of from about 1.0 per cubic centimeter to about 2.0 per cubic centimeter. The void distribution within the improved loosefill material 40 is in a range of from about 1.0 per cubic centimeter to about 2.0 per cubic centimeter.

In a first comparison between the conventional loosefill material 10 illustrated in FIG. 2 and the improved loosefill material 40 illustrated in FIG. 4, it can be seen that the void sizes of the improved loosefill material 40 are smaller than the void sizes within the conventional loosefill material 10 by an average amount within a range of from about 10% to about 30%.

Similarly, the void frequency of occurrence between the conventional loosefill material 10 illustrated in FIG. 2 and the improved loosefill material 40 illustrated in FIG. 4 can be compared. It can further be seen that the void frequency of occurrence within the improved loosefill material 40 is less than the void frequency of occurrence within the conventional loosefill material 10 by an amount within a range of from about 10% to about 30%.

The void distribution between the conventional loosefill material 10 illustrated in FIG. 2 and the improved loosefill material 40 illustrated in FIG. 4 can be compared. It can further be seen that the void distribution within the improved loosefill material 40 is more even than the void distribution within the conventional loosefill material 10 by an amount within a range of from about 10% to about 30%.

Without being bound by the theory, it is believed that the smaller, less frequent and more evenly distributed voids within the improved loosefill material 40 contribute to an improved insulative value.

Referring again to FIG. 4, the tufts 42 have a "major tuft dimension" MTD2. The major tuft dimension MTD2 of the tufts 42 is in a range of from about 2.5 mm to about 7.6 mm. Comparing the conventional loosefill material 10 illustrated in FIG. 2 and the improved loosefill material 40 illustrated in FIG. 4, it can be seen that the major tuft dimension MTD2 for the improved loosefill material 40 is relatively shorter than the major tuft dimension MTD1 of the conventional loosefill material 10 by an amount within a range of from about 10% to about 30%. Without being bound by the theory, it is believed that the shorter major tuft dimension MTD2 of the improved loosefill material 40 contributes to an improved insulative value.

Figure 6:
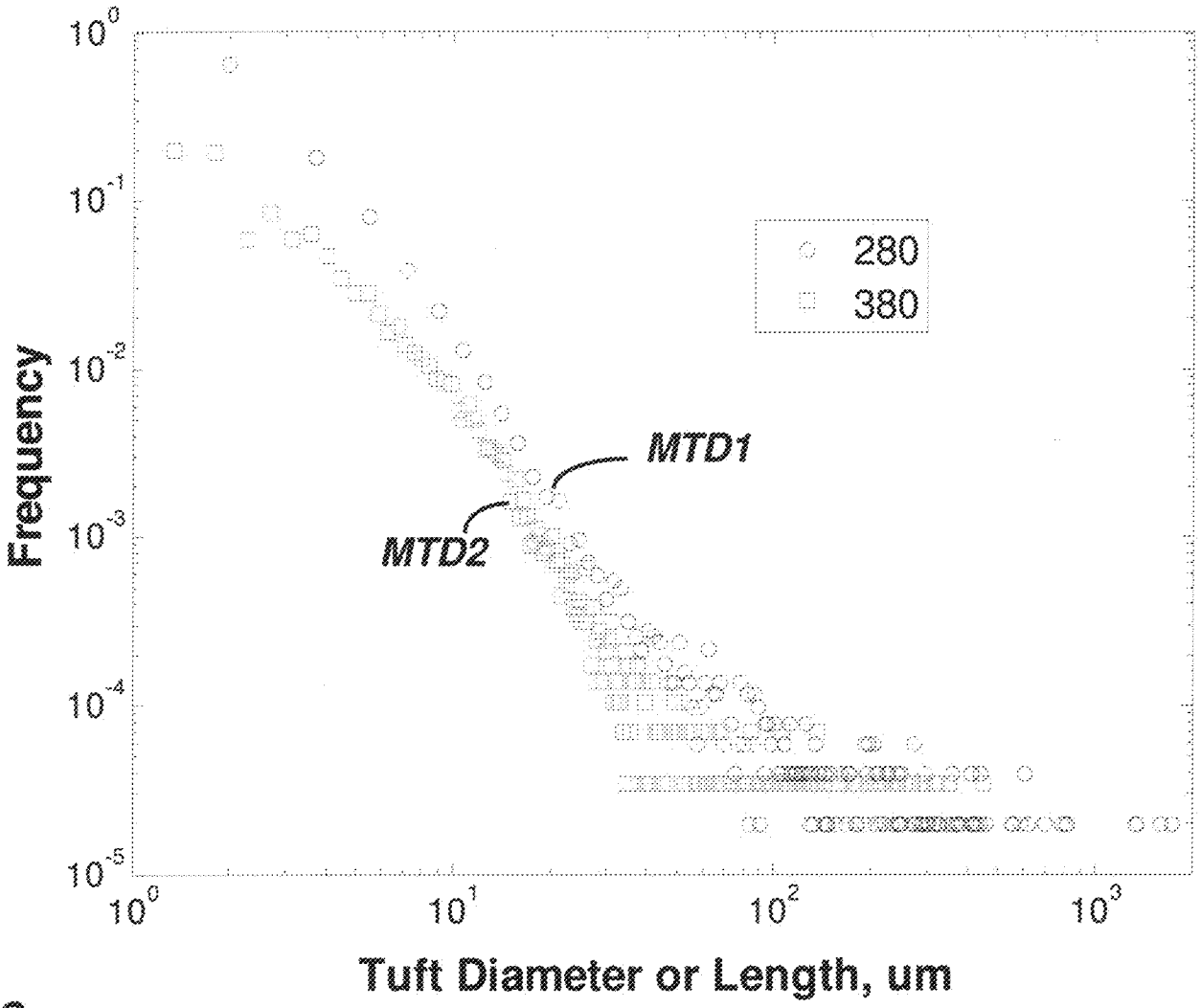
FIG. 6 is a color graph illustrating a comparison of the Major Tuft Dimension of the improved unbonded loosefill insulation material of FIG. 4 and the conventional unbonded loosefill insulation material of FIG. 2.

Referring now to FIG. 6, a graph depicting a statistical sampling of the major tuft dimension MTD2 of the improved loosefill material 40 (shown as "380") and the major tuft dimension MTD1 of the conventional loosefill material 10 (shown as "280") is presented. The results of the statistical sampling are used to compare the major tuft dimension MTD2 of the improved loosefill material 40 (shown as "380") and the major tuft dimension MTD1 of the conventional loosefill material 10 (shown as "280"). The graph of FIG. 6 has a vertical axis of Frequency (of measure) and a horizontal axis of Tuft Diameter or Length Tuft Sub-Structure Length (in units of um). As clearly shown in FIG. 6, the lengths MTD2 of the improved loosefill material 40 ("380") are shorter than the lengths MTD1 of the conventional loosefill material 10 ("280").

Referring again to FIG. 4, the tufts 42 have a tuft density. The tuft density of the tufts 42 is in a range of from about 4.0 kilograms per cubic meter to about 11.2 kilograms per cubic meter. Once again comparing the conventional loosefill material 10 illustrated in FIG. 2 and the improved loosefill material 40 illustrated in FIG. 4, it can be observed that the tuft density of the improved loosefill material 40 is relatively less dense than the tuft density of the conventional loosefill material 10 by an amount within a range of from about 10% to about 80%. Without being bound by the theory, it is believed that the less dense tuft density of the improved loosefill material 40 contributes to an improved insulative value and allows more coverage area per bag of insulation.

In one embodiment, the results of the pre-set and fixed operating parameters of the loosefill blowing machine 10, coupled with the loosefill material 60 described above, provide the improved insulative characteristics of the resulting blown insulation material as shown in Table 1.

TABLE 1

| Sample Number | Conventional Loosefill Material (volume fraction) | Improved Loosefill Material (volume fraction) |
|---|---|---|
| 1 | 0.043 | 0.022 |
| 2 | 0.031 | 0.0093 |
| 3 | 0.085 | 0.014 |
| Mean | 0.053 | 0.014 |
| Std. Dev. | 0.028 | 0.0064 |

As shown in Table 1, mean tuft density (referred to as volume fraction in Table 1) of the conventional loosefill material is 0.053 and the mean tuft density of the improved loosefill material is 0.014. As discussed above and confirmed in the date presented in Table 1, the tuft density of the improved loosefill material 40 is relatively less dense than the tuft density of the conventional loosefill material 10.

Figure 5:
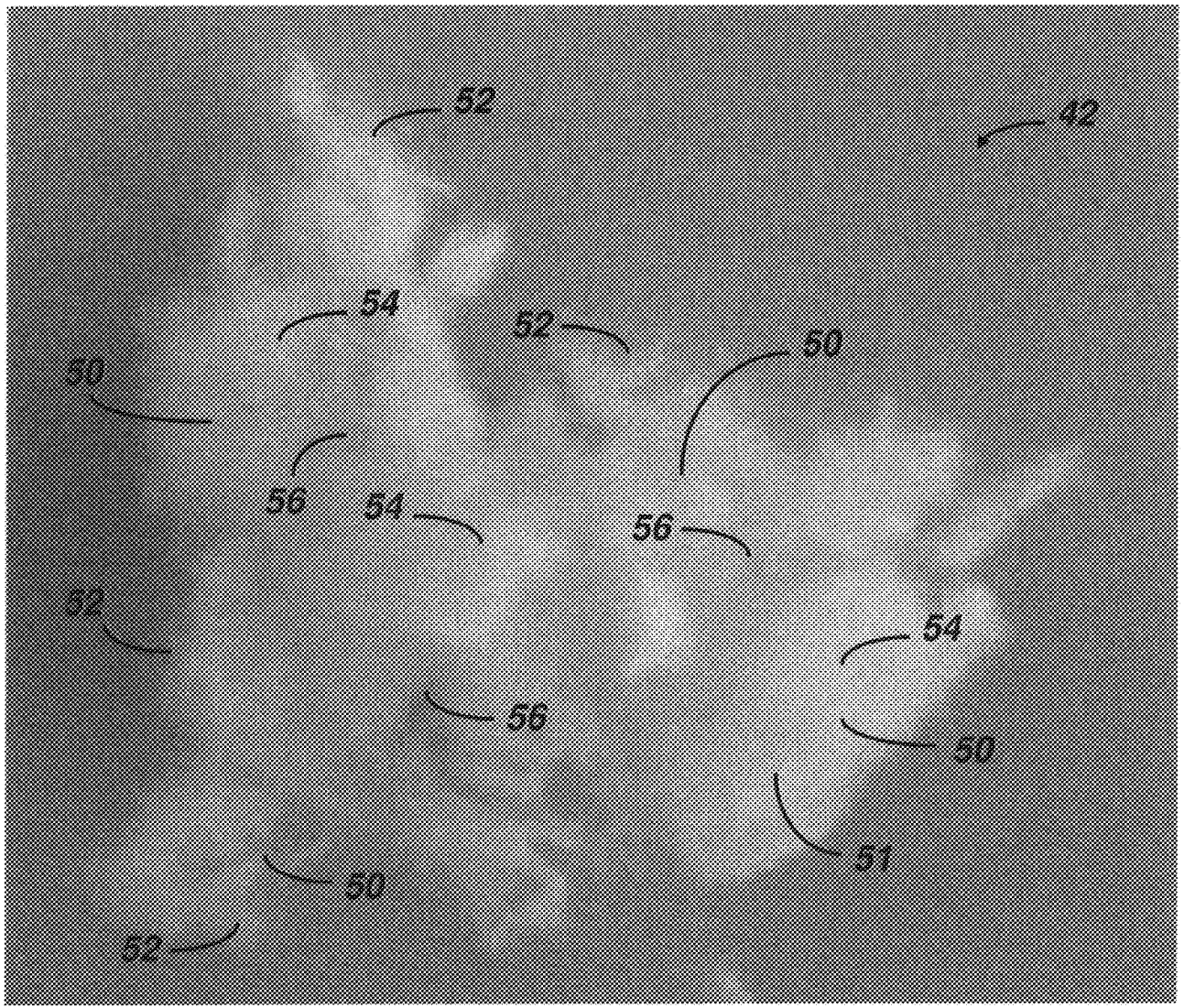
FIG. 5 is an enlarged color photograph illustrating an individual tuft of the improved loosefill insulation material of FIG. 4.

Referring now to FIG. 5, an individual tuft 42 of the improved loosefill material 40 is illustrated. For purposes of clarity, the individual tuft 42 has been magnified by an approximate factor of 8×. A fourth physical characteristic of the tuft 42 includes a plurality of irregularly-shaped projections 50 extending from an outer surface 51 of the tuft 42. As shown in FIG. 5, the outer surface 21 of the tuft 42 has irregularly-shaped projections in an amount in the range of from about 50% to 80%. Comparing the tufts 12 of the conventional loosefill material 10 illustrated in FIG. 3 and the tufts 42 of the improved loosefill material 40 illustrated in FIG. 5, it can be observed that the tufts 42 of the improved loosefill material 40 have relatively higher percentage of irregularly-shaped projections 50 extending from the outer surface 51 than the tufts 12 of the conventional loosefill material 10 by an amount within a range of from about 10% to about 30%. Without being bound by the theory, it is believed that the higher percentage of irregularly-shaped projections of the improved loosefill material 40 contributes to an improved insulative value.

Referring again to FIG. 5, the tufts 42 include a plurality of "hairs" 52 extending from the irregularly-shaped projections 50 of the tuft 42. As shown in FIG. 5, the quantity of irregularly-shaped projections 50 having extending hairs 52 is in a range of from about 60% to about 80%. Comparing the individual tuft 12 of the conventional loosefill material 10 illustrated in FIG. 3 and the individual tuft 42 of the improved loosefill material 40 illustrated in FIG. 5, it can be seen that the tuft 42 has relatively more hairs 52 extending from irregularly-shaped projections 50 by an amount in a range of from about 10% to about 30%.

Without being bound by the theories, it is believed that the increased quantity of the hairs 52 of the tuft 42 contribute to an improved insulative value for several reasons. First, it is believed that the hairs 52 extend into the voids, 44 and 46 as shown in FIG. 3, thereby partially filling the voids, which contributes to the ability of the improved loosefill material 40 to reduce radiation heat transfer between the tufts 42. Second, it is believed that the extended hairs 52 contribute in maintaining a separation between the tufts 42, which can substantially prevent an increased density of the improved loosefill material 40.

Referring again to FIG. 5, the tuft 42 includes a multiplicity of fibers 54 and a plurality of gaps 56. The gaps 56 have a gap size, a gap frequency of occurrence and a gap distribution. As discussed above, the gap size, gap frequency of occurrence and gap distribution are factors in determining the insulative value ("R value") of the loosefill material 40.

As shown in FIG. 5, the gap size of the improved loosefill material 40 is in a range of from about 1.2 mm to about 2.5 mm. The gap frequency of occurrence of the improved loosefill material 40 is in a range of from about 3.0 to about 5.0 per cubic centimeter. The gap distribution within the improved loosefill material 40 is in a range of from about 3.0 to about 5.0 per cubic centimeter.

Comparing the tuft 12 of the conventional loosefill material 10 illustrated in FIG. 3 with the tuft 42 of the improved loosefill material 40 illustrated in FIG. 5, it can be seen that the gap sizes within the tufts 42 of the improved loosefill material 40 are larger than the gap sizes within the conventional loosefill material 10 by an average amount within a range of from about 10% to about 30%.

Similarly, the gap frequency of occurrence between the tufts 12 of the conventional loosefill material 10 illustrated in FIG. 3 and the tufts 42 of the improved loosefill material 40 illustrated in FIG. 5 can be compared. It can further be seen that the gap frequency of occurrence within the tufts 42 of the improved loosefill material 40 is more than the gap frequency of occurrence of the tufts 12 within the conventional loosefill material 10 by an amount within a range of from about 10% to about 30%.

The gap distribution within the tufts 12 of the conventional loosefill material 10 illustrated in FIG. 3 and the tufts 42 of the improved loosefill material 40 illustrated in FIG. 5 can be compared. It can further be seen that the gap distribution within the tufts 42 of the improved loosefill material 40 is more even than the gap distribution within the tufts 12 of the conventional loosefill material 10 by an amount within a range of from about 10% to about 30%. Without being bound by the theory, it is believed that the larger, more frequent and more evenly distributed gaps 56 within the tufts 42 of the improved loosefill material 40 contribute to an improved insulative value.

Figure 7:
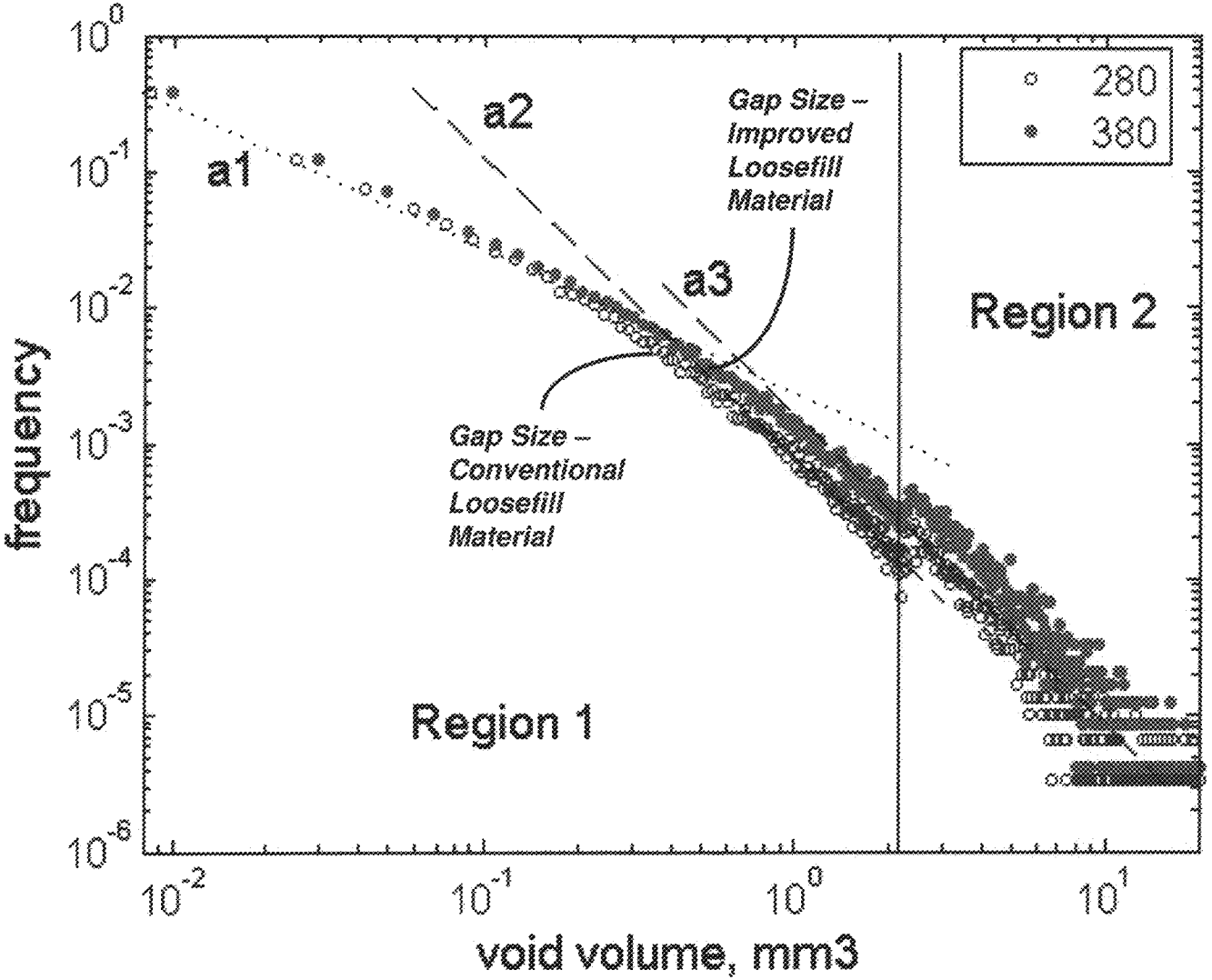
FIG. 7 is a color graph illustrating a comparison of the gap size of the improved unbonded loosefill insulation material of FIG. 4 and the conventional unbonded loosefill insulation material of FIG. 2.

Referring now to FIG. 7, a graph depicting a statistical sampling of the gap size of the improved loosefill material 40 (shown as "380") and the gap size of the conventional loosefill material 10 (shown as "280") is presented. The results of the statistical sampling are used to compare the gap size of the improved loosefill material 40 (shown as "380") and the gap size of the conventional loosefill material 10 (shown as "280"). The graph of FIG. 7 has a vertical axis of Frequency (of measure) and a horizontal axis of void volume (gap volume for the area designated as "Region 1") (in units of $m^3$). As clearly shown in FIG. 7, the gap within the improved loosefill material 40 ("380") are larger, more frequent and more evenly distributed than the gaps of the conventional loosefill material 10 ("280").

Referring again to FIG. 5, the tufts 42 have a more generally cubic consistency. As shown in FIG. 5, the tufts 42 fill a cubically-shaped volume in a range of from about 40% to about 80%. Comparing the individual tuft 12 of the conventional loosefill material 10 illustrated in FIG. 3 and the individual tuft 42 of the improved loosefill material 40 illustrated in FIG. 5, it can be seen that the tuft 42 has relatively more cubic consistency by an amount in a range of from about 10% to about 30%.

Without being bound by the theory, it is believed that the increased cubic consistency of the tuft 42 contributes to an improved insulative value of the improved loosefill material 40. It is believed that the cubic consistency of the tufts 42 allows the tufts 42 to "nest" at an optimum level. The term "nest", as used herein, is defined to mean the close fitting together of a plurality of tufts 42. It is believed that an optimum level of nesting by the tufts 42 provides an optimum insulative value of the improved loosefill material 40. In contrast, tufts 42 that nest too much, too close together, result in an unacceptably high density level of the improved loosefill material 40. Tufts 42 that nest too little result in an unacceptably poor insulative value. Accordingly, the increased cubic consistency of the tufts 42 provides a balance between the density of the improved loosefill material 40 and the insulative value of the improved loosefill material 40.

Figure 8:
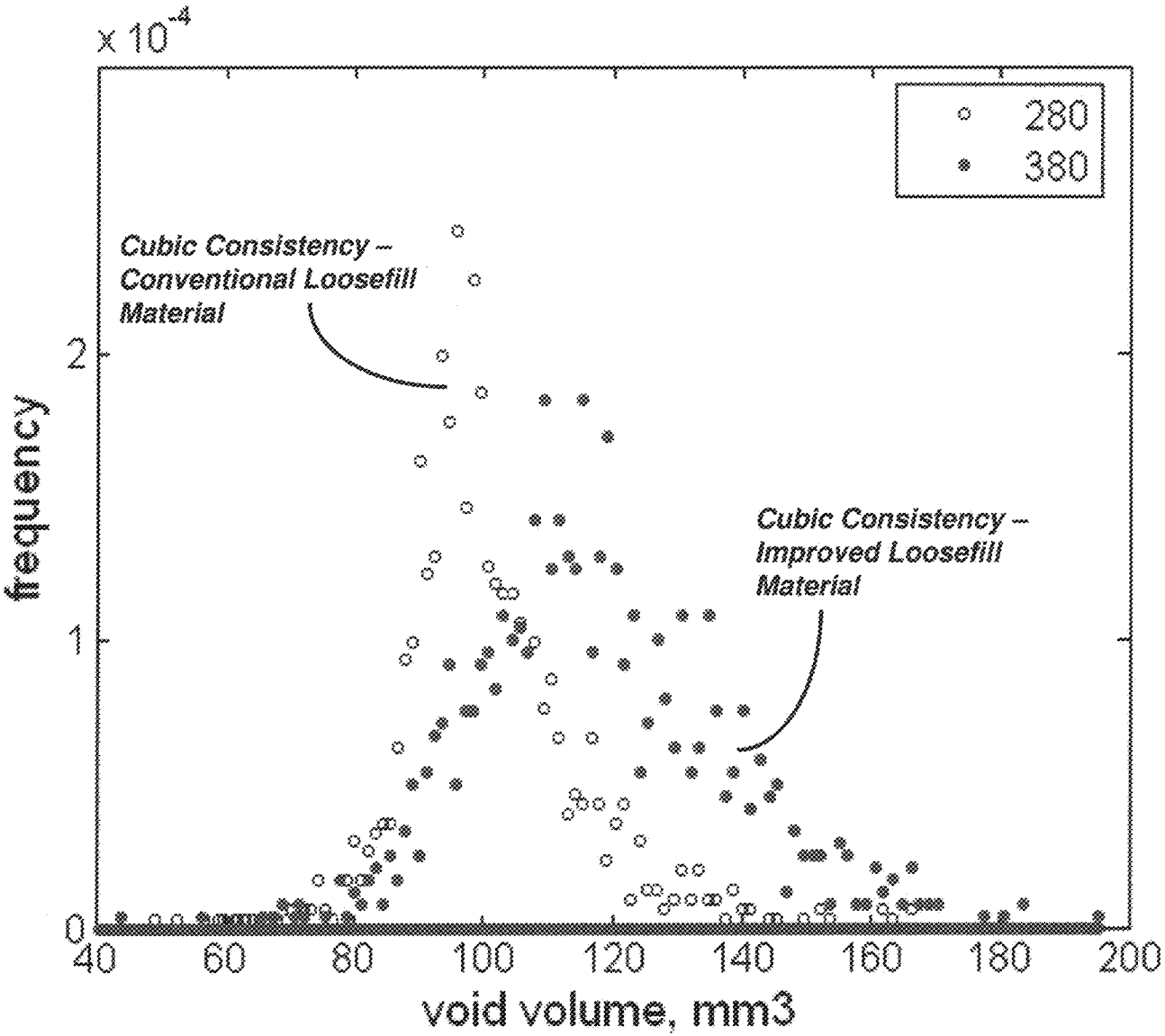
FIG. 8 is a color graph illustrating a comparison of the cubic consistency of the improved unbonded loosefill insulation material of FIG. 4 and the conventional unbonded loosefill insulation material of FIG. 2.

Referring now to FIG. 8, a graph depicting a statistical sampling of the cubic consistency of the improved loosefill material 40 (shown as "380") and the cubic consistency of the conventional loosefill material 10 (shown as "280") is presented. The results of the statistical sampling are used to compare the cubic consistency of the improved loosefill material 40 (shown as "380") and the cubic consistency of the conventional loosefill material 10 (shown as "280"). The graph of FIG. 8 has a vertical axis of Frequency (of measure) and a horizontal axis of void volume (in units of $m^3$). As clearly shown in FIG. 8, the cubic consistency of the improved loosefill material 40 ("380") is higher than the cubic consistency of the conventional loosefill material 10 ("280").

The physical characteristics discussed above for the improved loosefill material 40 and the tufts 42 contribute to an "open structure". That is, the voids, 44 and 46, major tuft dimension MTD2, tuft density, irregularly-shaped projections 50, extended hairs 52 and gaps 56 cooperate to form an "open structure" for the improved loosefill material 40. The term "open structure", as used herein, is defined to mean a relatively porous structure incorporating relatively numerous and large gaps or voids. Conversely, physical characteristics discussed above for the conventional loosefill material 10 and tufts 12 illustrated in FIGS. 2 and 3 combined to form a relatively "closed structure". The term "closed structure", as used herein, is defined to mean a more definitively defined boundary enclosing densely oriented fibers forming relatively few and small voids and gaps. It is believed the open structure of the improved loosefill material 40 provides an improved insulative value. The open structure of the improved loosefill material 40 will be discussed in more detail below.

The sample insulation products illustrated in FIGS. 2-5 are believed to be representative of conventional and the improved loosefill material respectively. It is to be understood that variations among samples may occur.

Figure 9:
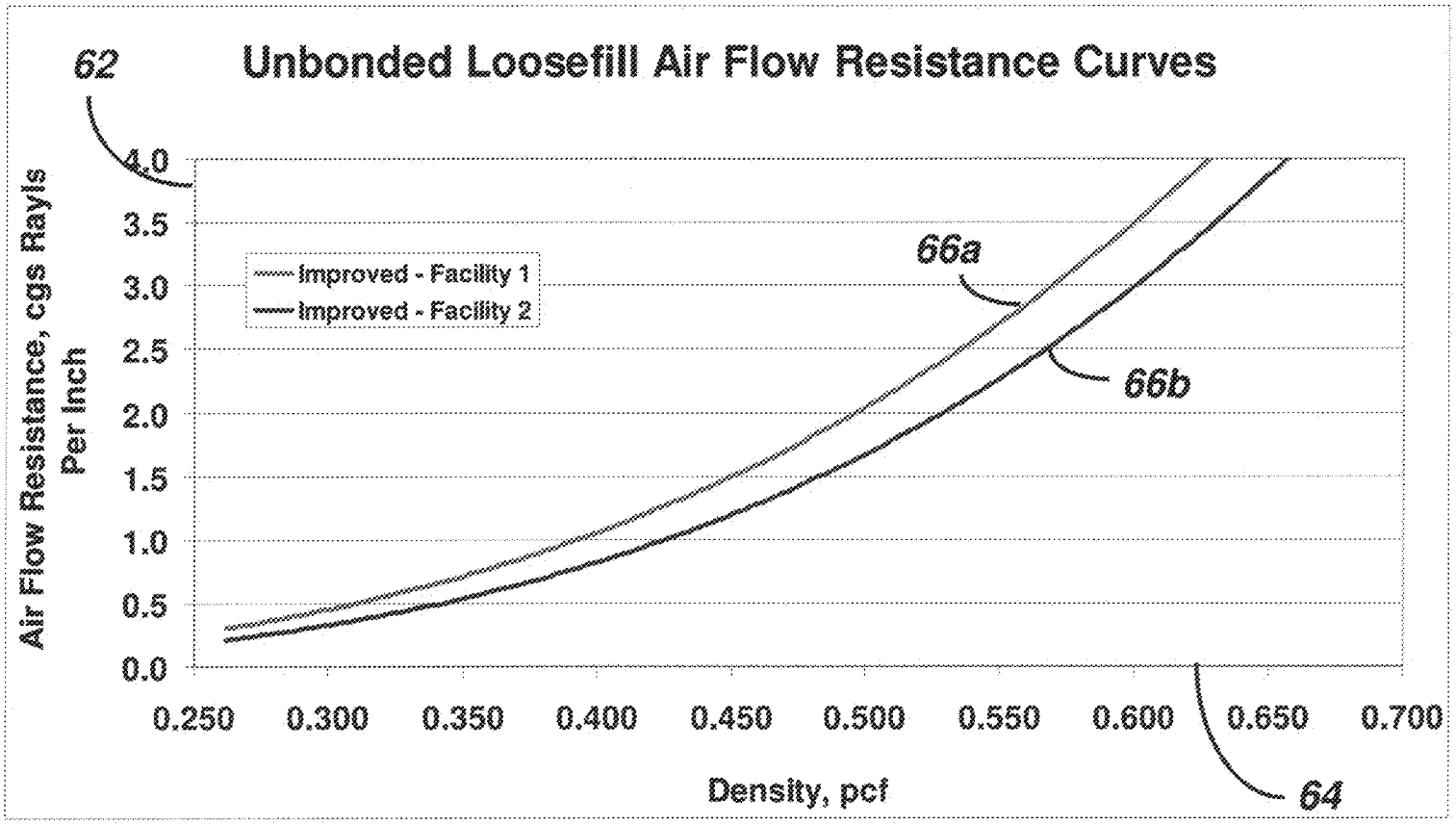
FIG. 9 is a color graph illustrating Air Flow Resistance vs. Density of the improved unbonded loosefill insulation material of FIG. 4 originating from different manufacturing facilities.

Referring now to FIG. 9, a graph of the performance of the improved loosefill material 40 is illustrated generally at 60. The graph 60 includes a vertical axis 62 of Air Flow Resistance and a horizontal axis 64 of Density. The Air Flow is measured in units of centimeter—gram—second Rayls Per Inch and the Density is measured as pounds per cubic foot. The term "Rayls", as used herein is defined to mean a unit of acoustic impedance. The data for the graph of FIG. 9 was generated using testing methods according to ASTM C522. Generally, the procedure for test method ASTM 522 involves placing a known mass of material into a specimen cavity. A measured amount of air is passed through the material and the pressure drop is measured through the specimen. The higher the pressure drop for the same flow rate, the higher the airflow resistance. The test is conducted at multiple densities. As shown in FIG. 9, the graph 60 includes trend lines 66*a* and 66*b* representing the data sets of the improved loosefill material 40 taken from various manufacturing facilities. As shown in FIG. 9, the Air Flow Resistance of the improved loosefill material 40 improves as the density of the improved loosefill material 40 increases.

Figure 10:
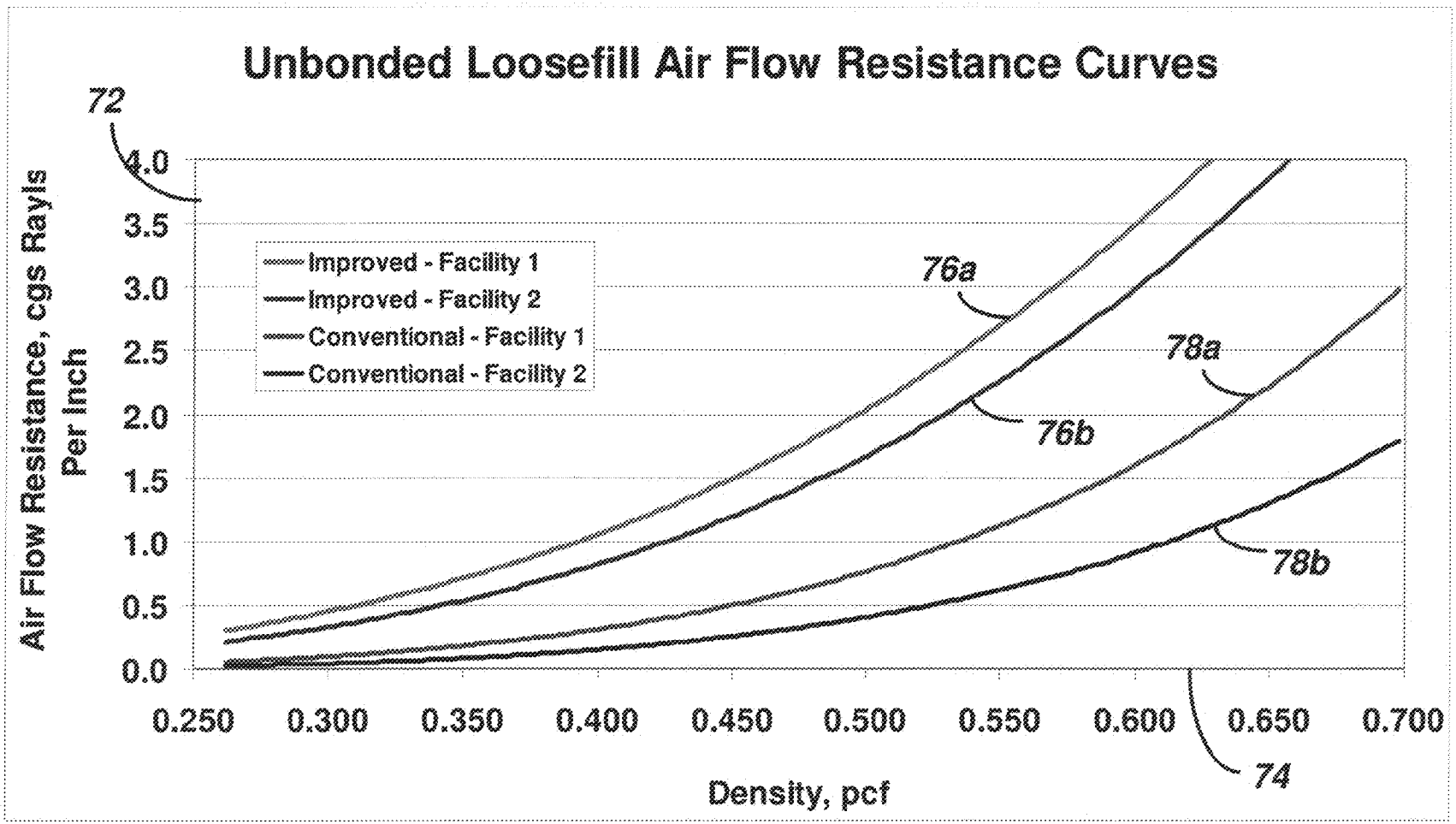
FIG. 10 is a color graph illustrating Air Flow Resistance vs. Density of the improved unbonded loosefill insulation material of FIG. 4 and the conventional unbonded loosefill insulation material of FIG. 2, both originating from different manufacturing facilities.

Referring now to FIG. 10, a graph of the performance of the improved loosefill material 40 and the conventional loosefill material 10 is illustrated generally at 70. The graph 70 includes a vertical axis 72 of Air Flow Resistance and a horizontal axis 74 of Density. The axes 72 and 74 illustrated in FIG. 10 are the same as or similar to the axes 62 and 64 illustrated in FIG. 9. The graph 70 also includes trend lines 76*a* and 76*b* representing the data sets of the improved loosefill material 40 taken from various manufacturing facilities. The trend lines 76*a* and 76*b* illustrated in FIG. 10 are the same as or similar to the trend lines 66*a* and 66*b* illustrated in FIG. 9.

As shown in FIG. 10, the graph 70 further includes trend lines 78*a* and 78*b* representing the data sets of the conventional loosefill material 10 taken from various manufacturing facilities. As shown in FIG. 10, the Air Flow Resistance of the conventional loosefill material 10 improves as the density of the loosefill material 10 increases. As can be clearly seen by the trend lines 76*a*, 76*b*, 78*a* and 78*b*, the improved loosefill material 40 provides an improved air flow resistance over the conventional loosefill material 10 regardless of the density. Without being bound by the theory, it is believed that a higher Air Flow Resistance provides a higher insulative value.

Referring again to FIG. 10, the fibers of the improved loosefill material 40 for trend lines 76*a* had a diameter of 13 HT, where HT stands for one-one hundred thousands of an inch. For example, 13 HT equals 0.00013 inches. The fibers of the improved loosefill material 40 for trend lines 76*b* also had a diameter of 13 HT and the fibers of the conventional loosefill material 10 for trend lines 78*a* and 78*b* had diameters of 13 HT. Conventional insulative theory provides that Air Flow Resistance can be improved by providing fibers having lower fiber diameters. However, the trend lines 76*a* and 76*b* for the improved loosefill material 40 unexpectedly do not follow the conventional insulative theory. As shown in FIG. 10, the fiber diameters for the improved loosefill material 40 are the same as the fiber diameters for the conventional loosefill material 10, and yet the improved loosefill material 40 provides greater Air Flow Resistance.

Referring now to FIG. 11, a chart of the performance of the improved loosefill material 40 is illustrated generally at 80. The chart 80 includes multiple data sets 82*a*-82*d*. The data sets 82*a*-82*d* were assembled from various manufacturing facilities. The data sets 82*a*-82*b* indicate the performance of the improved loosefill material 40 and the data sets 82*c*-82*d* indicate the performance of the conventional loosefill material 10. Conventional insulative theory provides that lower fiber diameters provide a lower Thermal Conductivity (k), where thermal conductivity is measured in units of Btu-in/(hr·$ft^2$·° F.). However, the data sets 82*a*-82*b* for the improved loosefill material 40 unexpectedly do not follow the conventional insulative theory. As shown in FIG. 11, the fiber diameters for the improved loosefill material 40 are generally larger than the fiber diameters for the conventional loosefill material 10, yet the improved loosefill material 40 provides lower Thermal Conductivity (k).

Figure 12:
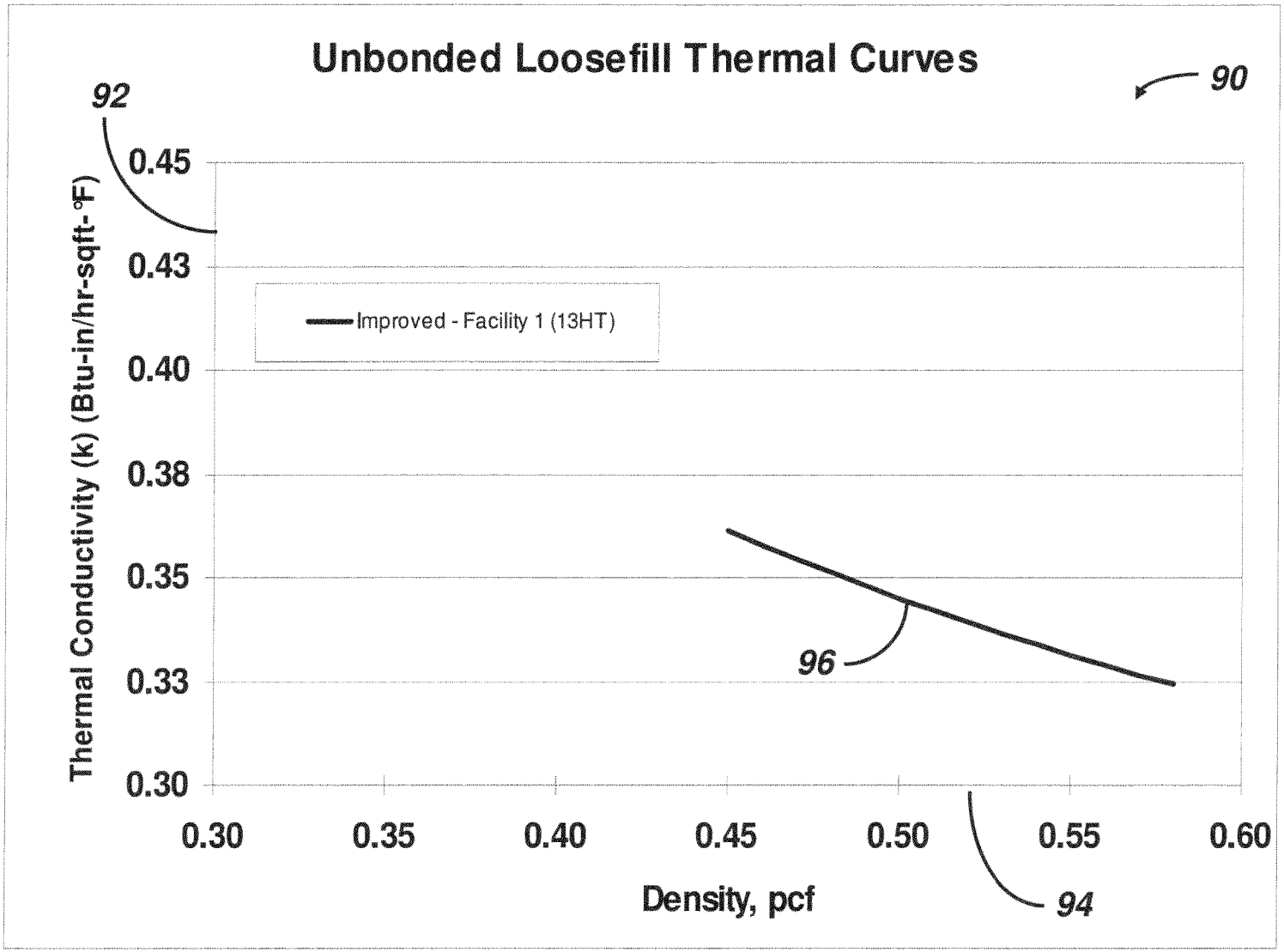
FIG. 12 is a color graph illustrating Thermal Conductivity vs. Density of the improved unbonded loosefill insulation material of FIG. 4.

Referring now to FIG. 12, a graph of the performance of the improved loosefill material 40 is illustrated generally at 90. The graph 90 includes a vertical axis 92 of Thermal Conductivity (k) and a horizontal axis 94 of Density. As shown in FIG. 12, the graph 90 includes trend line 96 representing a data set of the improved loosefill material 40. As further shown in FIG. 12, the Thermal Conductivity of the improved loosefill material 40 decreases as the density of the improved loosefill material 40 increases.

Figure 13:
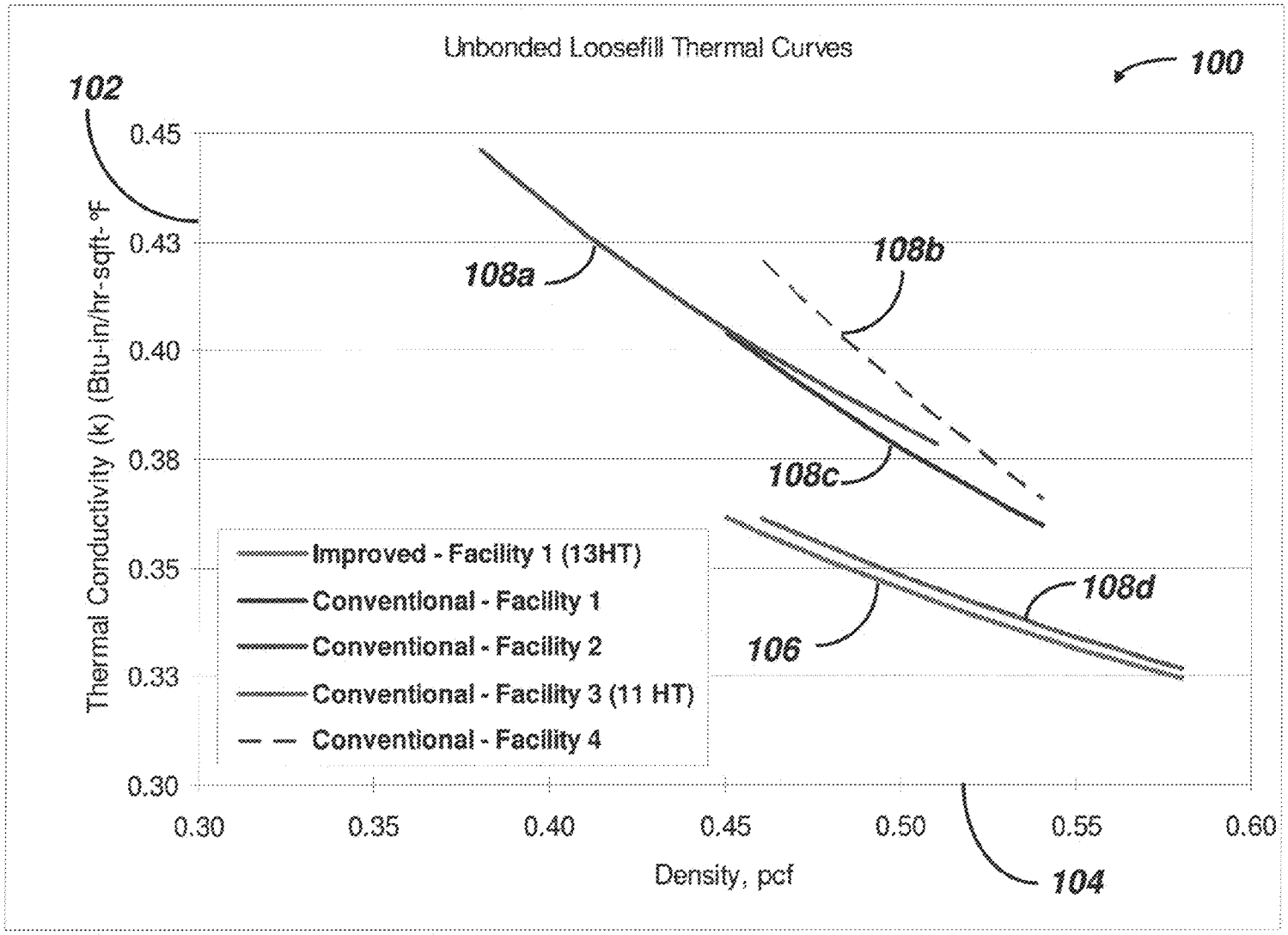
FIG. 13 is a color graph illustrating Thermal Conductivity vs. Density of the improved unbonded loosefill insulation material of FIG. 4 and the conventional unbonded loosefill insulation material of FIG. 2, both originating from different faculties.

Referring now to FIG. 13, a graph of the performance of the improved loosefill material 40 and the conventional loosefill material 10 is illustrated generally at 100. The graph 100 includes a vertical axis 102 of Thermal Conductivity and a horizontal axis 104 of Density. The axes 102 and 104 illustrated in FIG. 13 are the same as or similar to the axes 92 and 94 illustrated in FIG. 12. The graph 100 also includes trend line 106 representing the data set of the improved loosefill material 40. The trend line 106 illustrated in FIG. 13 is the same as or similar to the trend line 96 illustrated in FIG. 12.

As shown in FIG. 13, the graph 100 further includes trend lines 108*a*-108*d* representing the data sets of the conventional loosefill material 10 taken from various manufacturing facilities. As shown in FIG. 13, the Thermal Conductivity of the conventional loosefill material 10 also declines as the density of the loosefill material increases. Comparing trend line 106 for the improved loosefill material 40 with the trend lines 108*a*-108*c* for the conventional loosefill material 10, it can be clearly seen that the improved loosefill material 40 provides an improved Thermal Conductivity (k) over the conventional loosefill material 10 regardless of the density. Without being bound by the theory, it is believed that a lower Thermal Conductivity (k) provides a higher insulative value.

Referring again to FIG. 13, the fibers of the improved loosefill material 40 for trend lines 106 had a diameter of 13 HT. The fibers of the conventional loosefill material 10 for trend line 108*d* had diameters of 11 HT. As discussed above, conventional insulative theory provides that Thermal Conductivity can be improved by providing fibers having lower fiber diameters. However, the trend line 106 for the improved loosefill material 40 unexpectedly does not follow the conventional insulative theory. As shown in FIG. 13, the fiber diameters of the improved loosefill material 40 are the same as the fiber diameters for trend line 108*d* for the conventional loosefill material 10, yet the improved loosefill material 40 provides approximately the same Thermal Conductivity.

Given the unexpected results of FIGS. 6-13, the improved loosefill material 40 can, in certain instances, follow conventional insulative theory and in other instances not follow conventional insulative theory. Without being bound by the theory, it is believed that the improved loosefill material 40 has a more open fiber structure or matrix, thereby yielding the unexpected results.

Also without being held to the theory, it is believed that the fibers of the improved loosefill material have microscopic curves not shown in FIGS. 3 and 4. The existence of the microscopic curves can provide two results. First, the microscopic curves make it less likely that individual fibers will group together in substantially parallel, high density clumps. Second the microscopic curves make it more likely that the fibers will entangle in a random orientation, thereby facilitating the open structure of the improved loosefill material.

The principle and mode of operation of this improved loosefill material have been described in certain embodiments. However, it should be noted that the improved loosefill material may be practiced otherwise than as specifically illustrated and described without departing from its scope.

What is claimed is:

1. A loosefill insulation material comprising:

a multiplicity of tufts formed from unbonded individual fibers of insulative material, each of the unbonded individual fibers having a fiber diameter, wherein each of the unbonded individual fibers has the same fiber diameter, the tufts having a plurality of voids between the tufts, wherein when installed in an insulation cavity, the tufts have an outer surface that includes a plurality of irregularly-shaped projections, the tufts having an average major tuft dimension;

wherein when installed in an insulation cavity, the average major tuft dimension of the tufts of the unbonded loosefill insulation material has a length in a range of from about 2.5 mm to about 7.6 mm.

2. The unbonded loosefill insulation material of claim 1, wherein the average major tuft dimension of the unbonded loosefill insulation material is shorter than the average major tuft dimension of unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot by an amount in a range of from about 10% to about 30%.

3. An unbonded loosefill insulation material comprising:

a multiplicity of tufts formed from unbonded individual fibers of insulative material, each of the unbonded individual fibers having a fiber diameter, wherein each of the unbonded individual fibers has the same fiber diameter, and a plurality of voids between the tufts, wherein when installed in an insulation cavity, the tufts having an outer surface that includes a plurality of irregularly-shaped projections, the tufts having a tuft density;

wherein when installed in an insulation cavity, the tuft density of the tufts of the unbonded loosefill insulation material is in a range of from about 4.0 kilograms per cubic meter to about 11.2 kilograms per cubic meter.

4. The unbonded loosefill insulation material of claim 3, wherein the tuft density of the tufts of the unbonded loosefill insulation material is less than the tuft density of unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot by an amount in a percentage range of from about 10% to about 80%.

5. An unbonded loosefill insulation material comprising:

a multiplicity of tufts formed from unbonded individual fibers of insulative material, each of the unbonded individual fibers having a fiber diameter, wherein each of the unbonded individual fibers has the same fiber diameter, and a plurality of voids between the tufts, wherein when installed in an insulation cavity, the tufts have an outer surface that includes a plurality of irregularly-shaped projections;

wherein when installed in an insulation cavity, the tufts of the unbonded loosefill insulation material have irregularly-shaped projections in a percentage range of from about 50% to about 80% of it's outer surface.

6. The unbonded loosefill insulation material of claim 5, wherein the percentage of the outer surface of the tufts having irregularly-shaped projections is higher than the percentage of the outer surface of the tufts of unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot by an amount within a range of from about 10% to about 30%.

7. An unbonded loosefill insulation material comprising;

a multiplicity of tufts formed from unbonded individual fibers of insulative material, each of the unbonded individual fibers having a fiber diameter, wherein each of the unbonded individual fibers has the same fiber diameter, and a plurality of voids between the tufts, wherein when installed in an insulation cavity, the tufts have an outer surface formed from a plurality of irregularly-shaped projections, the irregularly-shaped projections having a plurality of hairs extending therefrom;

wherein when installed in an insulation cavity, approximately 60% to 80% of the irregularly-shaped projections have extending hairs.

8. The unbonded loosefill insulation material of claim 7, wherein the tufts of the unbonded loosefill insulation material have more hairs extending from irregularly-shaped projections than the tufts of unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot by an amount in a range of from about 10% to about 30%.

9. An unbonded loosefill insulation material comprising:

a multiplicity of tufts formed from unbonded individual fibers of insulative material, each of the unbonded individual fibers having a fiber diameter, wherein each of the unbonded individual fibers has the same fiber diameter, and a plurality of voids between the tufts, wherein when installed in an insulation cavity, the tufts have an outer surface that includes a plurality of irregularly-shaped projections, the tufts having tuft gaps within the tufts, the tuft gaps having a size;

wherein when installed in an insulation cavity, the size of the tuft gaps within the tufts of the unbonded loosefill insulation material is in a range of from about to about 1.2 mm to about 2.5 mm.

10. The unbonded loosefill insulation material of claim 9, wherein the size of the tuft gaps within the tufts of the unbonded loosefill insulation material is larger than the size of the gaps within the tufts of unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot by an amount in a range of from about 10% to about 30%.

11. An unbonded loosefill insulation material comprising:

a multiplicity of tufts formed from unbonded individual fibers of insulative material, each of the unbonded individual fibers having a fiber diameter, wherein each of the unbonded individual fibers has the same fiber diameter, and a plurality of voids between the tufts, wherein when installed in an insulation cavity, the tufts has an outer surface that includes a plurality of irregularly-shaped projections, the tufts having tuft gaps within the tufts, the tuft gaps having a gap frequency of occurrence;

wherein when installed in an insulation cavity, the gap frequency of occurrence of the tuft gaps within the tufts of the unbonded loosefill insulation material is in a range of from about to about 3.0 per cubic centimeter to about 5.0 per cubic centimeter.

12. The unbonded loosefill insulation material of claim 11, wherein the frequency of the tuft gaps within the tufts of the unbonded loosefill insulation material is more than the frequency of the tuft gaps within the tufts of unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot by an amount in a range of from about 10% to about 30%.

13. An unbonded loosefill insulation material comprising:

a multiplicity of tufts formed from unbonded individual fibers of insulative material, each of the unbonded individual fibers having a fiber diameter, wherein each of the unbonded individual fibers has the same fiber diameter, and a plurality of voids between the tufts, wherein when installed in an insulation cavity, the tufts have an outer surface that includes a plurality of irregularly-shaped projections, the tufts having tuft gaps within the tufts, the tuft gaps having a frequency of occurrence;

wherein when installed in an insulation cavity, the frequency of occurrence of the tuft gaps within the tufts of the unbonded loosefill insulation material results in no more than about 5.0 tuft gaps per cubic centimeter of unbonded loosefill insulation material.

14. The unbonded loosefill insulation material of claim 13, wherein the frequency of occurrence of the tuft gaps within the tufts of the unbonded loosefill insulation material is larger than the frequency of occurrence of the tuft gaps within the tufts of unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot by an amount in a range of from about 10% to about 30%.

15. An unbonded loosefill insulation material comprising:

a multiplicity of tufts formed from unbonded individual fibers of insulative material, each of the unbonded individual fibers having a fiber diameter, wherein each of the unbonded individual fibers has the same fiber diameter, and a plurality of voids between the tufts, wherein when installed in an insulation cavity, the tufts having an outer surface that includes a plurality of irregularly-shaped projections, the tufts having tuft gaps within the tufts, the tuft gaps having a gap distribution;

wherein when installed in an insulation cavity, the distribution of the tuft gaps within the tufts of the unbonded loosefill insulation material results in no more than about 5.0 tuft gaps per cubic centimeter of unbonded loosefill insulation material.

16. The unbonded loosefill insulation material of claim 15, wherein the distribution of the tuft gaps within the tufts of the unbonded loosefill insulation material is more even than the distribution of the tuft gaps within the tufts of the unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot by an amount in a range of from about 10% to about 30%.

17. An unbonded loosefill insulation material comprising;

a multiplicity of tufts formed from unbonded individual fibers of insulative material, each of the unbonded individual fibers having a fiber diameter, wherein each of the unbonded individual fibers has the same fiber diameter, the tufts having a plurality of voids between the tufts, wherein when installed in an insulation cavity, the tufts have an outer surface that includes a plurality of irregularly-shaped projections;

wherein when installed in an insulation cavity, the unbonded loosefill insulation material has a higher insulative value than unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot at the same fiber diameter.

18. The unbonded loosefill insulation material of claim 17, wherein the unbonded loosefill insulation material has a 10% to 30% higher insulative value than unbonded loosefill insulation material having an air flow resistance vs density curve defined by the data points of 0.050 cgs Rayls per inch at 0.250 pounds per cubic foot, 0.100 cgs Rayls per inch at 0.300 pounds per cubic foot, 0.150 cgs Rayls per inch at 0.350 pounds per cubic foot, 0.300 cgs Rayls per inch at 0.400 pounds per cubic foot, 0.500 cgs Rayls per inch at 0.450 pounds per cubic foot, 0.750 cgs Rayls per inch at 0.500 pounds per cubic foot, 1.150 cgs Rayls per inch at 0.550 pounds per cubic foot, 1.600 cgs Rayls per inch at 0.600 pounds per cubic foot, 2.210 cgs Rayls per inch at 0.650 pounds per cubic foot and 3.000 cgs Rayls per inch at 0.700 pounds per cubic foot at the same fiber diameter.

* * * * *